US007237302B2

(12) United States Patent
Bushey

(10) Patent No.: US 7,237,302 B2
(45) Date of Patent: Jul. 3, 2007

(54) WRAP AROUND FURNITURE GUIDE

(76) Inventor: Richard D. Bushey, 1596 38th Ave., Kenosha, WI (US) 53140

( * ) Notice: Subject to any disclaimer, the term of this patent is extended or adjusted under 35 U.S.C. 154(b) by 0 days.

(21) Appl. No.: 11/033,356

(22) Filed: Jan. 11, 2005

(65) Prior Publication Data

US 2005/0150076 A1 Jul. 14, 2005

Related U.S. Application Data

(60) Provisional application No. 60/536,079, filed on Jan. 13, 2004.

(51) Int. Cl.
*B60B 33/06* (2006.01)
*A47B 91/00* (2006.01)

(52) U.S. Cl. ..... 16/32

(58) Field of Classification Search ..... 16/430, 16/435, 428, 42 R, 42 T, 18 CG; 135/77, 135/82; 248/346.11, 188.4, 188.6, 188.9; 297/239, 248

See application file for complete search history.

(56) References Cited

U.S. PATENT DOCUMENTS 1,112,828 A * 10/1914 Neuberth ..... 16/42 T
1,230,836 A * 6/1917 Ballenberg ..... 16/42 R
1,382,833 A * 6/1921 Hurd ..... 182/108
1,383,806 A * 7/1921 Haynes ..... 411/503
1,486,267 A * 3/1924 Salomon ..... 16/42 R
1,603,876 A 10/1926 Shapard
1,690,754 A * 11/1928 Rosenthal ..... 248/188.9
1,804,841 A * 5/1931 Pedroli ..... 248/345.1
1,818,211 A * 8/1931 Duncan, Jr. ..... 248/188.9
1,861,095 A 5/1932 Schacht
1,867,736 A 7/1932 Finkeldey
1,903,609 A 4/1933 Uhl
1,915,272 A 6/1933 Duncan, Jr.
1,982,138 A 11/1934 Herold
2,030,649 A 2/1936 Miller
2,116,941 A * 5/1938 Francis ..... 135/78
2,234,577 A * 3/1941 Reiter ..... 24/265 A
2,262,063 A 11/1941 Swarr
2,262,064 A 11/1941 Swarr
2,633,599 A 4/1953 Dolan
2,644,978 A 7/1953 Becker
2,710,027 A 6/1955 Husgen et al.
2,753,586 A 7/1956 Metz
2,794,205 A 6/1957 Skupas
2,820,240 A 1/1958 Matys
2,840,113 A 6/1958 Simpson et al.
2,848,733 A 8/1958 Thornsbury
2,865,133 A 12/1958 Hoven et al.

(Continued)

*Primary Examiner*—Robert J. Sandy
*Assistant Examiner*—André L. Jackson
(74) *Attorney, Agent, or Firm*—Boyle Fredrickson Newholm Stein & Gratz S.C.

(57) ABSTRACT

A furniture glide is provided for mounting to a leg of a piece of furniture. The furniture glide having an inner surface for engaging a bottom of the leg of the piece of furniture and an outer surface for engaging a supporting surface. A first and second sidewalls project from opposite sides of the base and have inner surfaces for engaging opposites sides of the leg of the piece of furniture. Each sidewall is pivotable between a first storage position wherein the sidewall is spaced from a corresponding side of the leg and a second operating position wherein the sidewall is in engagement with the corresponding side of the leg.

7 Claims, 3 Drawing Sheets

U.S. PATENT DOCUMENTS 2,875,552 A 3/1959 Stillman
2,878,509 A 3/1959 Fisher
2,888,775 A * 6/1959 Thoeming ..... 248/188.9
2,902,794 A 9/1959 Ehrgott
2,904,294 A * 9/1959 Marygold ..... 248/74.4
2,933,754 A 4/1960 Winans
2,954,636 A 10/1960 Gammache
2,968,116 A 1/1961 Arenson
2,974,352 A 3/1961 Lockwood
2,988,770 A 6/1961 Arenson
2,992,509 A 7/1961 Gaenzle
3,059,267 A 10/1962 Wilhelmi
3,078,498 A 2/1963 Morgan
3,177,518 A 4/1965 Bergstrom
3,183,545 A 5/1965 Bergstrom
3,191,212 A 6/1965 Reiss, Sr. et al.
3,254,362 A * 6/1966 Rasor et al. ..... 16/42 R
3,342,445 A 9/1967 Bouwkamp
3,353,231 A 11/1967 Levine
3,389,421 A 6/1968 Wheeler
3,505,724 A 4/1970 Leitner et al.
3,620,896 A * 11/1971 Glasgow ..... 428/167
3,634,925 A * 1/1972 Van Loo ..... 29/458
3,640,496 A 2/1972 Duncan
3,845,924 A 11/1974 Taviere et al.
3,883,923 A 5/1975 England
4,327,460 A 5/1982 Wolff
4,468,910 A 9/1984 Morrison
D276,606 S 12/1984 Neuwirth
4,576,357 A 3/1986 Schrepfer
4,654,245 A 3/1987 Balzer et al.
5,005,374 A 4/1991 Spitler
5,010,621 A 4/1991 Bock
5,042,764 A 8/1991 Carpinella et al.
5,057,356 A 10/1991 Smith
5,081,740 A 1/1992 Smith
5,094,416 A 3/1992 Huon
5,160,105 A * 11/1992 Miller ..... 248/188.9
5,170,972 A 12/1992 Guell
5,220,705 A 6/1993 Bushey
D339,560 S 9/1993 Byrd
D348,985 S 7/1994 Walker
5,330,814 A * 7/1994 Fewell ..... 428/42.2
D353,505 S 12/1994 Rea
5,426,818 A 6/1995 Bushey
5,469,599 A 11/1995 Wurdack
5,513,900 A * 5/1996 Iglesias ..... 297/463.1
5,557,824 A 9/1996 Bushey
5,573,212 A 11/1996 Palazzolo
5,573,213 A 11/1996 Henderson et al.
D376,944 S 12/1996 Dunn
5,591,974 A 1/1997 Troyer et al.
5,603,140 A * 2/1997 Pryce ..... 16/18 CG
D381,865 S 8/1997 Gallagher
5,680,673 A 10/1997 Beshore
5,782,444 A 7/1998 Anderman et al.
5,802,669 A 9/1998 Wurdack
D400,088 S 10/1998 Hurrie
5,898,975 A * 5/1999 Hancock ..... 16/114.1
5,946,737 A * 9/1999 Fleege ..... 2/455
D415,672 S * 10/1999 Students et al. ..... D8/356
6,088,877 A 7/2000 Swy et al.
6,154,923 A 12/2000 Carpinella
6,280,817 B1 8/2001 McCrossin et al.
6,324,725 B1 12/2001 Green
6,353,951 B1 * 3/2002 Gramling ..... 5/663
D455,383 S 4/2002 Sneed
6,647,589 B1 * 11/2003 Youngwith ..... 16/18 CG
6,855,651 B2 * 2/2005 Yu ..... 442/149

* cited by examiner

WRAP AROUND FURNITURE GUIDE

CROSS-REFERENCE TO RELATED APPLICATIONS

This application claims the benefit of U.S. Provisional Application Ser. No. 60/536,079, filed Jan. 13, 2004.

FIELD OF THE INVENTION

This invention relates generally to furniture glides, and in particular, to a furniture glide that wraps around a base portion of a tubular chair frame or a foot mounted to the terminal end of a leg of a piece of furniture.

BACKGROUND OF THE INVENTION

Coasters are often used under the legs of a piece of furniture to act as a buffer between the legs and the floor on which the piece of furniture rests. Typically, coasters take the form of glass or rubber discs having flat bottoms that rest on the floor. By positioning the coasters between the furniture legs and the floor, the weight of the furniture leg is dispersed over a larger area such that the furniture leg does not scratch or mar the floor when the piece of furniture is moved or leave a depression in the floor when the piece of furniture remains in one place for an extended period of time.

In addition, furniture glides or sliders have been developed that are also positioned between the legs of a piece of furniture and the carpeting on which the piece of furniture rests. By way of example, Bushey, U.S. Pat. No. 5,220,705 discloses a furniture glide that facilitates the movement of a piece of furniture on carpeted and bare floors. The furniture glide includes a convo-convex disc having an arcuate convex lower surface, a concave upper surface defining a central cavity, and resilient pad fixed to the disc upper surface within the central cavity below the edge thereof. Adhesive is provided for securing the resilient pad to the bottom of the piece of furniture or to the leg of the piece of furniture.

While functional for their intended purpose, prior art furniture glides have certain limitations. More specifically, these furniture glides are designed for mounting onto the bottoms of pieces of furniture or on the legs thereof. As a result, the furniture glides do not fit properly on pieces of furniture that are fabricated using tubular frames, such as office chairs and the like. Further, repeated movement of a piece of furniture along a floor may cause the furniture glide to become detached from the bottom of the piece of furniture. As a result, the furniture glide may become separated from the piece of furniture such that the bottom of piece of furniture may engage and damage the flooring. Therefore, it is highly desirable to provide a furniture glide and/or coaster that may be simply secured to various types of furniture in order to prevent damage to the flooring on which the piece of furniture rests.

Therefore, it is a primary object and feature of the present invention to provide a furniture glide that may be securely retained on a tubular frame of a piece of furniture.

It is a further object and feature of the present invention to provide a furniture glide that is inexpensive to manufacture and simple to utilize.

It is a still further object and feature of the present invention to provide a furniture glide that is more securely retained on the leg of a piece of furniture than prior furniture glides.

In accordance with the present invention, a furniture glide is provided for mounting to a leg of a piece of furniture. The furniture glide includes a base having an inner surface for engaging a bottom of the leg of the piece of furniture and an outer surface for engaging the supporting surface. A first sidewall projects from a first side of the base and has an inner surface for engaging a first side of the leg of the piece of furniture and an outer surface.

The base is generally flat and it is contemplated for the first sidewall to be pivotable between a first storage position wherein the first sidewall is spaced from the side of the leg and a second operating positioning wherein the first sidewall is in engagement with the leg. A second sidewall projects from a second side of the base and has an inner surface for engaging a second side of the leg of the piece of furniture. The second sidewall is pivotable between a first storage position wherein the second sidewall is spaced from the second side of the leg and a second operating position wherein the second sidewall is in engagement with the second side of the leg.

The base extends along the longitudinal axis and the outer surface of the first sidewall includes a first slit. The first slit is generally parallel to the longitudinal axis. It is contemplated to provide additional slits in the first sidewall and/or to provide additional slits in the outer surface of the second sidewall.

The base, the first sidewall and the second sidewall have predetermined thicknesses. The predetermined thickness of the base is greater than the predetermined thicknesses of the first and second sidewalls. In an alternate embodiment, it is contemplated for the outer surface of the first sidewall to have a generally sinusoidal cross-section. In a still further embodiment, it is contemplated for the inner surface of the base and the inner surface of the sidewall to define a generally concave cavity for receiving a portion of the leg of the piece of furniture therein.

In accordance with a further aspect of the present invention, a furniture glide is provided for mounting to a leg of a piece of furniture. The furniture glide includes a base extending along a longitudinal axis and having a first face, a second face and an outer periphery. The base includes a central portion having first and second sides and a predetermined thickness. First and second side portions extend laterally from corresponding sides of the central portion. Each side portion has a predetermined thickness. An adhesive is provided on the first face of the base for affixing the base to the leg of the piece of furniture.

The base includes a first slit in a first side portion along the second face. The first slit is generally parallel to the longitudinal axis. The base may also include a second slit in the second side portion along the second face, the second slit is generally parallel to the longitudinal axis. The base may also include a second slit in the first side portion of the second face.

It is contemplated for the predetermined thickness of the central portion of the base to be greater than the predetermined thickness of the side portions of the base. In an alternate embodiment, the second face of the base along the first side portion has a generally sinusoidal cross-section. It is contemplated for the base to have an oval configuration.

In accordance with a still further aspect of the present invention, a furniture glide is provided for mounting to a leg of a piece of furniture. The furniture glide includes a base extending along the longitudinal axis and having an inner surface for engaging a bottom of the leg of the piece of furniture and an outer surface for engaging a supporting surface. A first sidewall projects from the first side of the base and has an inner surface for engaging a first side of the leg of the piece of furniture. The outer surface of the first sidewall has a plurality of slits formed therein. A second sidewall projects from the second side of the base and has an inner surface for engaging a second side of the leg of the piece of furniture. The outer surface of the second sidewall has a plurality of slits formed therein. The first sidewall is pivotable between a storage position wherein the first sidewall is spaced from the first side of the leg and a second operating position wherein the first sidewall is in engagement with the first side of the leg. The second sidewall is pivotable between a first storage position wherein the second sidewall is spaced from the second side of the leg and a second operating position wherein the second sidewall is in engagement with the second side of the leg.

The plurality of slits in the first sidewall and the plurality of slits in the second sidewall are generally parallel to the longitudinal axis. The first sidewall, the second sidewall and the base have predetermined thicknesses. It is contemplated for the predetermined thickness of the base to be greater then the predetermined thicknesses of the first and second sidewalls.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DESCRIPTION OF THE PREFERRED EMBODIMENT

Figure 1:
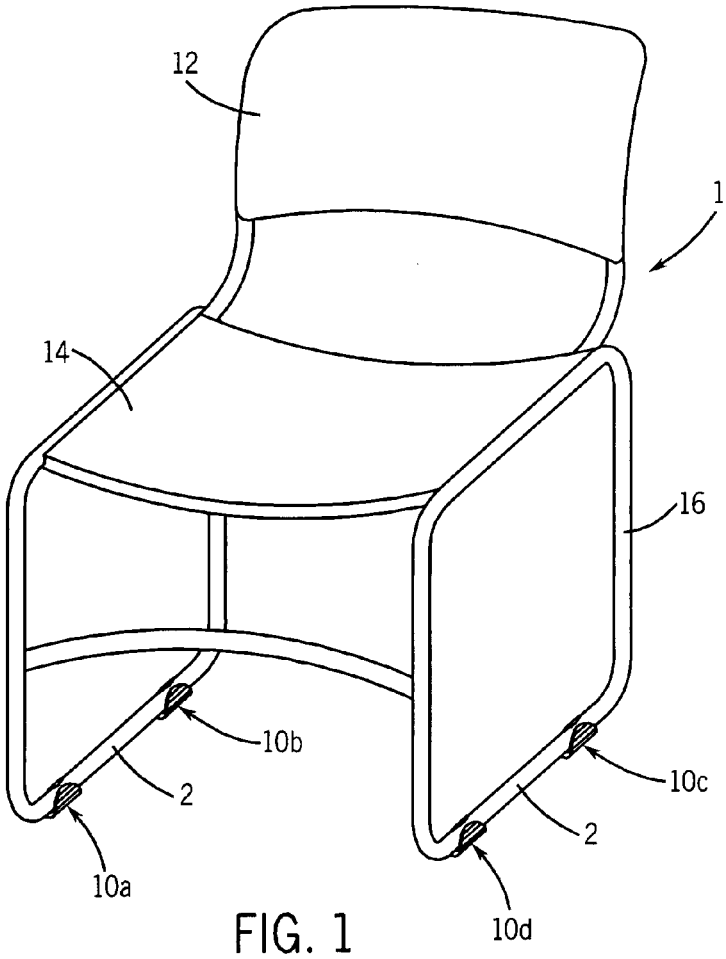
FIG. 1 is an isometric view of a chair incorporating a first embodiment of a furniture glide in accordance with the present invention mounted thereto.
Figure 2:
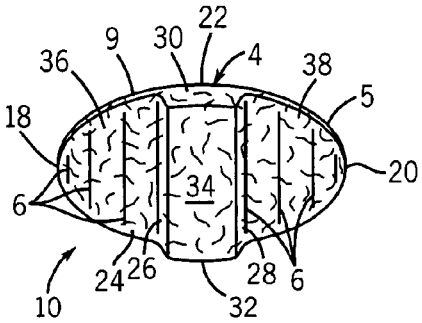
FIG. 2 is a bottom plan view of a first embodiment of a furniture glide in accordance with the present invention.

Referring to FIGS. 1–2, a wrap around furniture glide in accordance with the present invention is generally designated by the reference numeral 10. It is intended that furniture glide 10 be receivable on base portion 2 of a conventional chair 1. Chair 1 includes backing member 12 and seating member 14 interconnected by a tubular frame 16. Tubular frame 16 includes two, generally parallel, horizontal base portions 2 which are intended to support chair 1 on a supporting surface such as a floor or the like.

As best seen in FIG. 2, furniture glide 10 is generally oblong in shape and includes first and second opposite ends 18 and 20, respectively, and inner and outer surfaces 22 and 24, respectively. It is noted that furniture glide 10 may be round or have other configurations without deviating from the scope of the present invention. It is intended that inner surface 22 include an adhesive thereon for affixing furniture glide 10 to base portion 2 of chair 1. Furniture glide 10 further includes a generally rectangular floor engaging element 4 extending from outer surface 24 thereof and having first and second sides 26 and 28, respectively, and first and second ends 30 and 32, respectively, that partially define outer periphery 9 of floor guide 10. Floor engaging element 4 terminates at a generally flat floor engaging surface 34.

Furniture glide 10 further includes a plurality of generally parallel slits 6 extending between inner surface 22 and outer surface 24 thereof. A first set of slits 6 is provided in first portion 36 of furniture glide 10 and extends between side 26 of floor engaging element 4 and first end 18 of furniture glide 10. A second set of slits 6 is provided in second portion 38 of furniture glide 10 between side 28 of floor engaging element 4 and second end 20 of furniture glide 10. Slits 6 allow furniture glide 10 to be wrapped around base portion 2 of chair frame 16 as hereinafter described. It can be appreciated that slits 6 may extend partially into furniture glide 10 from inner surface 22 or may extend partially into furniture glide 10 from outer surface 24 without deviating from the scope of the present invention.

It is noted that floor engaging element 4 has a predetermined thickness that is greater than the thickness of first and second portions 36 and 38, respectively, of furniture leg 10. The predetermined thickness of floor engaging element 4 of furniture glide 10 adds durability to furniture glide 10 allowing chair 1 to be repeatedly slid over the supporting surface without damage to furniture glide 10.

Figure 3:
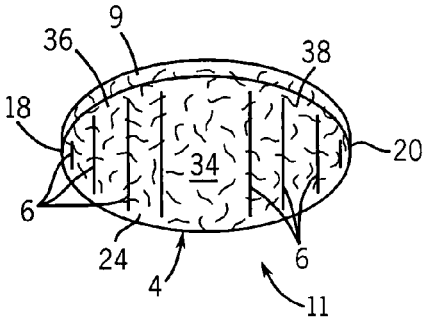
FIG. 3 is a bottom plan view of a second embodiment of a furniture glide in accordance with the present invention.
Figure 4:
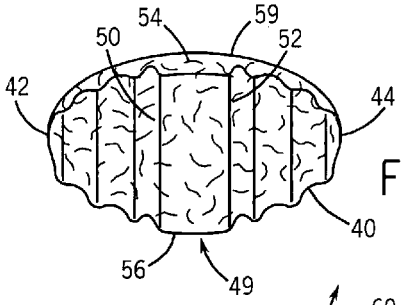
FIG. 4 is a bottom plan view of a third embodiment of a furniture glide in accordance with the present invention.
Figure 5:
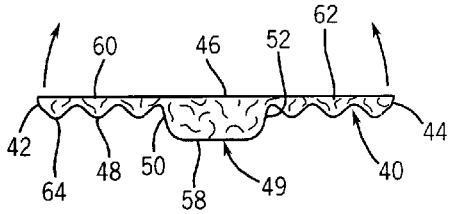
FIG. 5 is a side elevational view of the furniture glide of FIG. 4.

Referring to FIG. 3, an alternate embodiment of a furniture glide in accordance with the present invention is generally designated by the reference numeral 11. Furniture glide 11 is identical in structure to furniture glide 10 except as hereinafter provided, and as such, common reference characters will be used. In furniture glide 11, floor engaging surface 34 of floor engaging element 4 lies in a common plane with outer surface 24 thereof. As a result, outer periphery 9 of furniture glide 11 has a uniform width. It can be appreciated that furniture glide 11 may be mounted on base portion 2 of a chair frame 16 in the same manner as furniture glide 10 is mounted.

In operation, furniture glide 10 is positioned underneath base portion 2 of chair frame 16 such that floor engaging surface 34 of floor engaging element 4 is directed away from chair frame 16. First and second portions 36 and 38, respectively, of furniture glide 10 are wrapped around base portion 2 of chair frame 16 such that the entirety of inner surface 22 engages the corresponding outer surface of base portion 2 of chair frame 16. The adhesive on inner surface 22 of furniture glide 10 retains furniture glide 10 on base portion 2 of chair frame 16. It can be appreciated that the process may be repeated so as to mount additional furniture glides 10*a*–10*c* on base portions 2 of chair frame 16 of chair 1.

Referring to FIGS. 4–7, an alternate embodiment of a furniture glide in accordance with the present invention is generally designated by the reference numeral 40. Furniture glide 40 includes first and second ends 42 and 44, respectively, and inner and outer surfaces 46 and 48, respectively.

Floor engaging element 49 projects from outer surface 48 of furniture glide 40 and is defined by first and second sides 50 and 52, respectively, and first and second opposite ends 54 and 56, respectively, which are coincident with outer periphery 59 of furniture glide 40. Floor engaging element 49 terminates at a generally flat floor engaging surface 58.

Furniture glide 40 further includes first portion 60 extending between first side 50 of floor engaging element 49 and first end 42 of furniture glide 40 and second portion 62 extending between second side 52 of floor engaging element 49 and second end 44 of furniture glide 40. Generally parallel ribs 64 are spaced along outer surface 48 of furniture glide 10 between first end 42 and first side 50 of floor engaging element 49, as well as, between second side 52 of floor engaging element 49 and second end 44 of furniture glide 40 such that outer surface 48 has correspondingly first and second generally sinusoidal cross sections. Ribs 64 facilitate the wrapping around of first and second portions 60 and 62, respectively, of furniture glide 40 about outer surface 2*a* of base portion 2 of chair frame 16 of chair 1. It can be appreciated that slits may be provided between adjacent ribs 64 in furniture glide 40 without deviating from the scope of the present invention.

Figure 6:
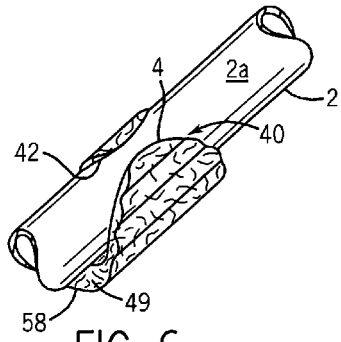
FIG. 6 is an isometric view showing the furniture glide of FIG. 4 mounted to a portion of a chair.
Figure 7:
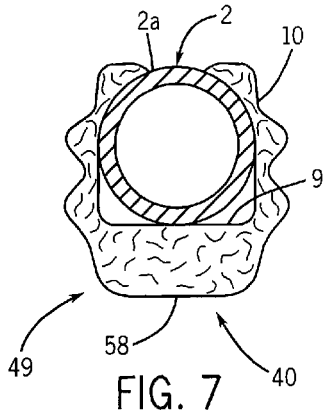
FIG. 7 is a end view, partially in section, showing the furniture glide of FIG. 6.

In operation, furniture glide 40 is positioned adjacent base portion 2 of chair frame 16 of chair 1 at a user desired location such that inner surface 46 of furniture glide 40 is directed towards base portion 2 of chair frame 16 and such that floor engaging surface 58 of floor engaging element 49 of furniture guide 40 is directed away from chair frame 16. As best seen in FIGS. 6 and 7, first and second portions 60 and 62 of furniture glide are wrapped around outer periphery 2*a* of base portion 2 of chair frame 16 such that the entirety of inner surface 46 of furniture glide 40 is in engagement with outer periphery 2*a* of base portion 2 of chair frame 16. Adhesive on inner surface 46 maintains furniture glide 40 on base portion 2 of chair frame 16.

Figure 8:
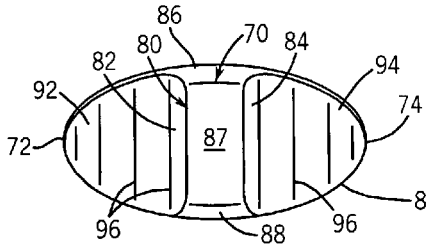
FIG. 8 is a bottom plan view of a fourth embodiment of a furniture glide in accordance with the present invention.
Figure 9:
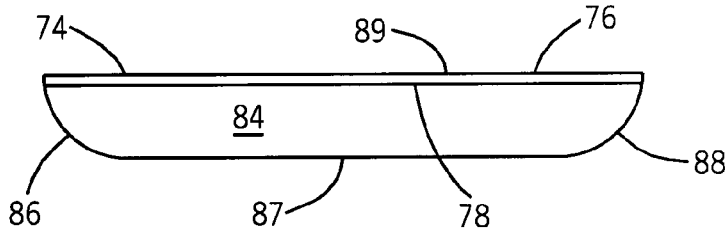
FIG. 9 is an end view of the furniture glide of FIG. 8.
Figure 10:
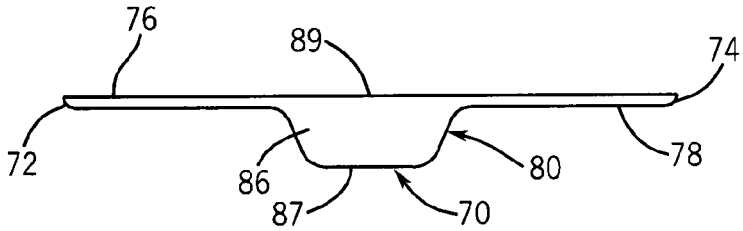
FIG. 10 is a side elevational view of the furniture glide of FIG. 8.

Referring to FIGS. 8–10, a still further embodiment of a furniture glide in accordance with the present invention is generally designated by the reference numeral 70. Furniture glide 70 is formed from a plastic or pliable material and includes first and second ends 72 and 74, respectively, and inner and outer surfaces 76 and 78, respectively. Floor engaging element 80 projects from outer surface 78 of furniture glide 70 and is defined by first and second sides 82 and 84, respectively, and first and second ends 86 and 88, respectively. Floor engaging element 80 terminates at a generally flat, floor engaging surface 87. A first set of slits is provided in first portion 92 of furniture glide 70 between first end 72 of furniture glide 70 and first side 82 of floor engaging element 80. A second set of slits 96 is provided in second portion 94 of furniture glide 70 between second side 84 of floor engaging element 80 and second end 74 of furniture glide 70. Slits 96 may extend entirely through furniture glide 70 from outer surface 78 to inner surface 76 or partially therethrough.

In operation, furniture glide 70 is positioned adjacent base portion 2 of chair frame 16 such that inner surface 76 of furniture glide 70 is directed towards outer periphery 2*a* of a base portion 2 of chair frame 16 and such that the floor engaging surface 87 of floor engaging element of furniture glide 70 is directed away from chair frame 16. First and second portions 92 and 94, respectively, of furniture glide 70 are wrapped around outer periphery 2*a* of base portion 2 of chair frame 16 such that the entirety of inner surface 76 of furniture glide 70 engages outer periphery 2*a* of base portion 2 of chair frame 16. Adhesive 89 may be provided along the inner surface furniture glide 70 in order to retain furniture glide 70 on base portion 2 of chair frame 16. The process may be repeated multiple times in order to mount additional furniture glides 70 on the base portions 2 of chair frame 16.

Figure 11:
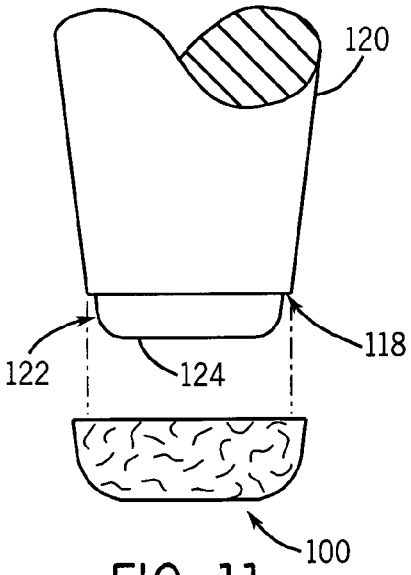
FIG. 11 is a side elevational view of a fifth embodiment of a furniture glide in accordance with the present invention to be mounted on a leg of a piece of furniture.
Figure 12:
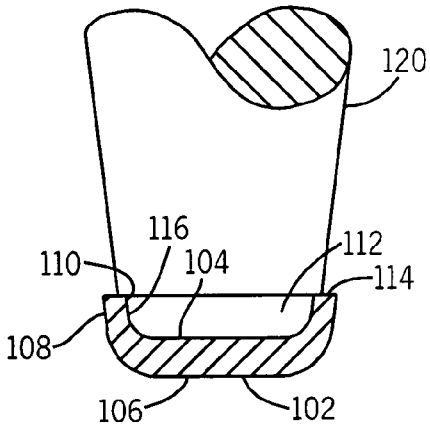
FIG. 12 is a side elevational view, partially in section, showing the furniture glide of FIG. 11 mounted on a leg of a piece of furniture.

Referring to FIGS. 11–12, an alternate embodiment of a furniture glide in accordance with the present invention is generally designated by the reference numeral 100. Furniture glide 100 includes a base portion 102 having inner surface 104 and generally flat outer surface 106. Sidewall 108 projects generally vertically from base 102 and includes an inner surface 110, which together with inner surface 104 of base 102, define a generally concave cavity 112 within furniture glide 100. Adhesive is provided along the entirety of inner surface 104 and inner surface 110.

Sidewall 108 of furniture glide 100 terminates at an upper end 114. Upper end 114 of sidewall 108 of furniture glide 100 includes an inner edge 116 that defines an opening that allows for terminal end 118 of a furniture leg 120 to be inserted into cavity 112 in furniture glide 100. As best seen in FIG. 11, furniture leg 120 includes slider 122 having a generally convex outer surface 124 secured to terminal end 118 thereof.

In operation, furniture glide 100 is positioned over slider 122 such that outer surface 124 of slider 122 mounted on terminal end 118 of furniture leg 120 forms a mating relationship with inner surface 110 of sidewall 108 and with inner surface 104 of base 102 of furniture glide 100. It is contemplated to fabricate furniture glide 100 from a pliable material such as felt in order that the inner surface 110 of sidewall 108 of furniture glide 100 and inner surface 104 of base 102 of furniture glide 100 deform to a shape corresponding to the shape of outer surface 124 of slider 122 mounted to terminal end 118 of furniture glide 120. The adhesive provided on inner surfaces 104 and 110 retains furniture glide 100 on furniture leg 120.

Various modes of carrying out the invention are contemplated as being within the scope of the following claims particularly pointing out and distinctly claiming the subject matter which is regarded as the invention.

I claim:

1. A furniture glide for mounting to a leg of a piece of furniture, comprising:

a generally flat base having an inner surface for engaging a bottom of the leg of the piece of furniture and an outer surface, the base including first and second ends; and a furniture engaging element projecting from the outer surface of the base, the furniture engaging element including a first side laterally spaced from the first end of the base, a second side laterally spaced from the second end of the base, and a generally flat floor engaging surface extending between the first and second sides;

wherein:

the base includes a first side portion defined between the first end of the base and the first side of the floor engaging element, a second side portion defined between the second end of the base and the second side of the floor engaging element;

the first and second side portions of the base are movable between first positions wherein the inner surface of the base is generally planer and second position wherein the inner surface of the base is arcuate for wrapping around the leg of the piece of furniture;

wherein:

the base extends along a longitudinal axis;

the outer surface of the first side portion of the base includes a first slit, the first slit being generally transverse to the longitudinal axis;

the outer surface of the first side portion of the base includes a second slit, the second slit being generally transverse to the longitudinal axis; and the outer surface of the second side portion of the base includes a second slit, the second slit being generally transverse to the longitudinal axis.

2. A furniture glide for mounting to a leg of a piece of furniture, comprising:

a base extending along a longitudinal axis and having first and second ends, a first face, a second face and an outer periphery, the base including:

a central portion having first and second sides; and first and second sides portions extending laterally from corresponding sides of the central portion, the side portions pivotable between first positions wherein first face of the base is generally planar and second positions;

a furniture engaging element projecting from the second face of the central portion of the base, the furniture engaging element including a first side laterally spaced from the first end of the base, a second side laterally spaced from the second side of the base, and a generally flat floor engaging surface extending between the first and second sides; and an adhesive on the first face of the base for affixing the base to the leg of the piece of furniture;

wherein:

the base includes a first slit in the first side portion along the second face, the first slit being generally transverse to the longitudinal axis; and the base includes a second slit in the second side portion along the second face, the second slit being generally transverse to the longitudinal axis.

3. The furniture glide of claim 2 wherein the base includes a second slit in the first side portion along the second face, the second slit being generally parallel to the first slit in the first side portion.

4. The furniture glide of claim 2 wherein the base has a generally oval configuration.

5. A furniture glide for mounting to a leg of a piece of furniture comprising:

a base extending along a longitudinal axis and having first and second ends, an inner surface for engaging a bottom of the leg of the piece of furniture and an outer surface;

a furniture engaging element projecting from the outer surface of the base, the furniture engaging element including first and second sides and a generally flat floor engaging surface extending between the first and second sides;

a first sidewall projecting laterally from a first end of the base and having an inner surface for engaging a first side of the leg of the piece of furniture and an outer surface, the outer surface of the first sidewall having a plurality of slits formed therein; and a second sidewall projecting laterally from a second end of the base and having an inner surface for engaging a second side of the leg of the piece of furniture and an outer surface, the outer surface of the second sidewall having a plurality of slits formed therein;

wherein:

the first and second sidewalls are pivotable between first storage positions wherein the inner surfaces of the first and second sidewalls are generally co-planer with the inner surface of the base and second operating positions wherein the first and second sidewalls are in engagement with the leg.

6. The furniture glide of claim 5 wherein the plurality of slits in the first sidewall are generally transverse to the longitudinal axis.

7. The furniture glide of claim 6 wherein the plurality of slits in the second sidewall are generally transverse to the longitudinal axis.

* * * * *